United States Patent [19]

Crowe

[11] 3,958,282

[45] May 25, 1976

[54] PORTABLE SEAT LIFT FOR USE IN BATHTUBS

[76] Inventor: Wylie W. Crowe, 438 18th Ave., Indian Rocks Beach, Fla. 33535

[22] Filed: July 30, 1974

[21] Appl. No.: 493,034

[52] U.S. Cl. ..... 4/185 L; 248/157

[51] Int. Cl.[2] ..... A47K 3/12

[58] Field of Search ..... 4/185 AB, 185 L, 185 S; 5/81, 83; 248/157, 404; 297/347, 339

[56] References Cited

UNITED STATES PATENTS

| | | | |
|---|---|---|---|
| 2,270,233 | 1/1942 | Shaw | 297/347 |
| 2,314,044 | 3/1943 | Hunting | 4/185 L |
| 2,752,986 | 7/1956 | Kastner | 4/185 L |
| 3,166,282 | 1/1965 | Nolan | 297/347 |
| 3,256,036 | 6/1966 | Nolan | 297/347 |
| 3,271,791 | 9/1966 | Sarff | 4/185 L |
| 3,806,194 | 4/1974 | Kolebaba | 297/347 |

*Primary Examiner*—Roy D. Frazier
*Assistant Examiner*—Lawrence J. Staab
*Attorney, Agent, or Firm*—Newton, Hopkins & Ormsby

[57] ABSTRACT

A portable seat lift is disclosed for use in bathtubs. The seat lift comprises a base sized for placement upon a bathtub floor between the bathtub walls. A pair of mutually spaced hydraulic cylinders extend upwardly from the base with each cylinder including a moveable piston rod. A seat is mounted to the piston rods between the hydraulic cylinders. Hydraulic line means are provided for coupling the hydraulic cylinders with a faucet through which line water may be passed under pressure to drive the hydraulic cylinders in altering the elevation of the seat.

3 Claims, 5 Drawing Figures

PORTABLE SEAT LIFT FOR USE IN BATHTUBS

BACKGROUND OF THE INVENTION

This invention relates generally to seat and chair lifts, and particularly to portable seat and chair lifts adapted for use in partially submerging people in and emerging them from water confined within bathtubs and the like.

Seat and chair lifts have heretofore been developed for use in lowering and raising the infirmed and aged into and out of bathtubs. Most such seat and chair lifts are permanently mounted within or form an integral part of therapeutic type bathtubs such as those found in hospitals and nursing homes. Portable seat lifts however, such as that disclosed in U.S. Pat. No. 2,679,890, have also been devised for use in home bathtubs without need for permanently attaching or affixing the lifts to the tubs or making alterations to the tub bodies to accomodate them.

Portable type seat lifts of the prior art have not found wide acceptance due to several persistant problems foremost of which being that of stability. These types of seat lifts have tended to wobble in operation both during raising and lowering operations as well as during pivotable movement in repositioning the seats over the edge of the tubs for mounting and dismounting. In their lowermost position the seats have been located a significant distance above the bottom of the tubs whereby the body of the person seated thereupon is not submerged as far as possible within the tub water. Moreover, in many cases the portable seat lifts have been operable by manipulation of controls readily accessible only to a bather attendant. In addition, the power means for operating the lifts has also been bulky and expensive, such typically being in the form of electric powered hydraulic pump systems having system components seated both within and without the bounds of the tub.

Accordingly, it is a general object of the present invention to provide an improved portable seat lift for use in bathtubs.

More specifically, it is the object of the present invention to provide a portable seat lift for use in bathtubs which lift exhibits substantial stability during operation.

Another object of the invention is to provide a portable seat lift for bathtubs which may be operated by a person seated upon the lift.

Another object of the invention is to provide a portable seat lift which does not require ancillary motor means not normally available within a bathroom.

Yet another object of the invention is to provide a portable seat lift of simple and economic construction and one which enables the user to be submerged to a point closely adjacent the bottom of bathtubs.

SUMMARY OF THE INVENTION

In a preferred form of the invention a portable seat lift is provided for a bathtub comprising a base sized for placement upon the bathtub floor between the bathtub walls. A pair of mutually spaced hydraulic cylinders extend upwardly from the base with each cylinder including a moveable piston rod. A seat is mounted to the piston rods between the hydraulic cylinders. Hydraulic line means are provided for coupling the hydraulic cylinders with a faucet through which line water may be passed under pressure to drive the hydraulic cylinders in altering the elevation of the seat.

DETAILED DESCRIPTION OF THE DRAWING

Figure 1:
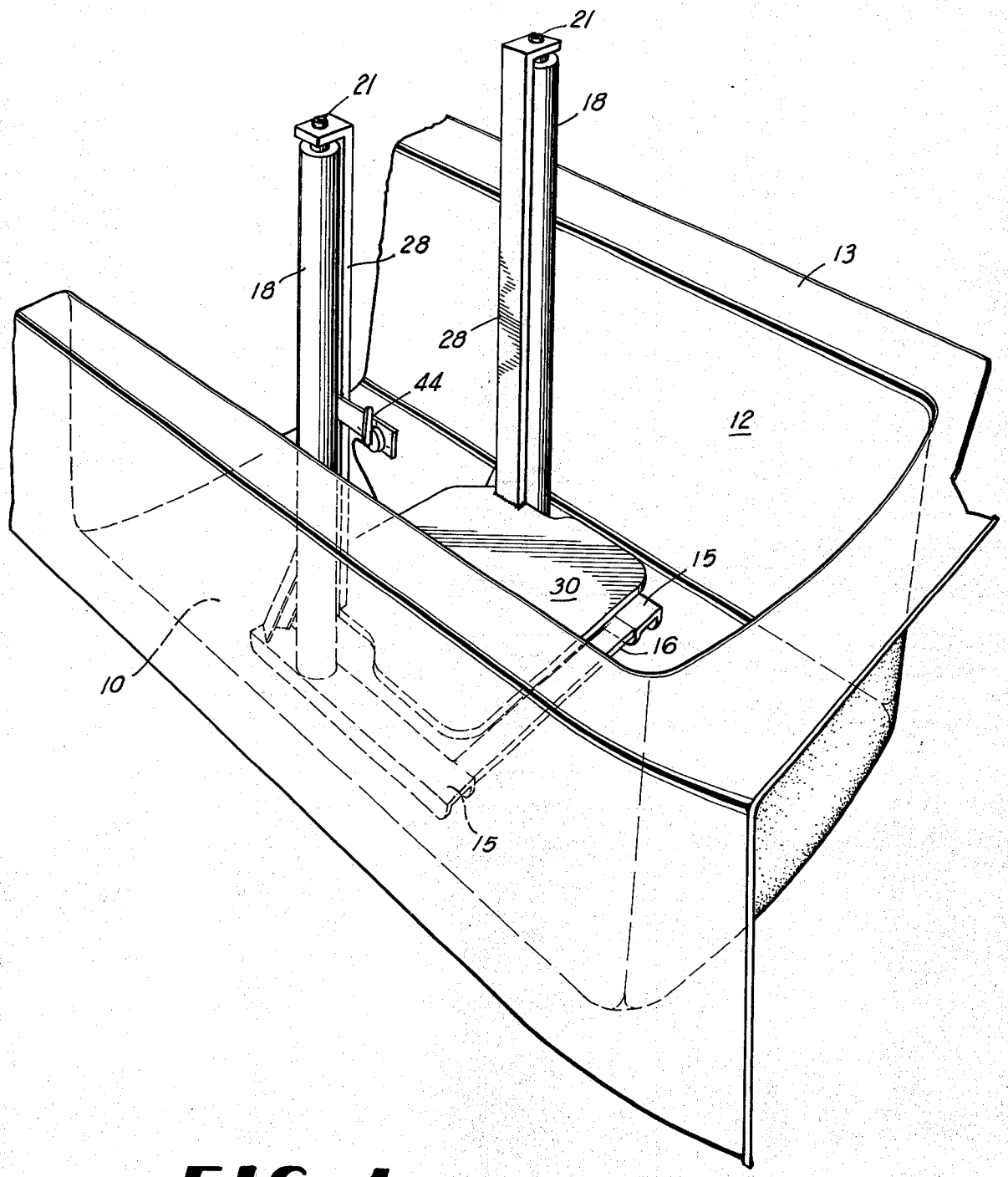
FIG. 1 is a perspective view of a portable seat lift embodying principles of the invention in one preferred form shown disposed in a lowered position disposed in a bathtub.

Referring now in more detail to the drawing, there is shown in FIG. 1 a bathtub having a floor 10 surrounded by tub walls 12 having a substantially planer upper surface 13. A portable seat lift embodying principles of the present invention in a preferred form is shown removably seated within the tub in this figure in a seat lowered condition. The lift includes a base comprising a pair of spaced, parallel, longitudinally extending, vinyl coated, aluminum, inverted, U-shaped, complementary, channel members 15 joined together at their forward end portions by a transversely extending brace 16. Thus the base comprises in plan view a U-shaped frame.

A pair of upstanding hollow tubular complementary cylinders 18 are firmly mounted respectively by their lower ends to the upper surfaces of the webs of members 15. The cylinders 18 are mounted intermediate the ends of the members 15, respectively, and project upwardly, parallel to each other.

Figure 3:
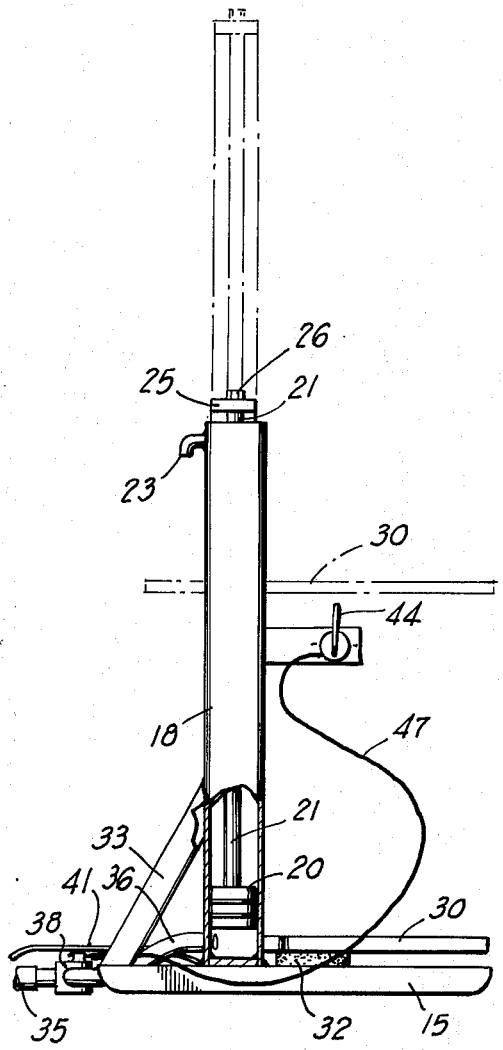
FIG. 3 is a side view in elevation of the portable seat lift shown in FIGS. 1 and 2 with a portion thereof shown broken away revealing interior components thereof.

As seen in FIG. 3, each cylinder 18 includes a piston 20 slideably carried within the cylinder 18 from movement in a vertical path therein. The piston 20 is provided with an upstanding piston rod 21 which projects through the upper cap on the upper end of the cylinder 18 so as to terminate outwardly of the cylinder. Each cylinder 18 is a single acting cylinder, having an air vent 23 for maintaining the air pressure within the cylinder 18 on one side of piston 20 at substantially the pressure of the ambient air. The upper end portions of the piston rods 21 are of reduced diameter and respectively project through holes in the central portions of a pair of flat rectangular horizontally disposed caps 25. Nuts 26 threaded onto the end portions of the pistons 21 retain the caps are rigidly in place.

Secured to the inner edge portions of the caps 25 are a pair of opposed downwardly projecting straight rectangular seat supporting legs 28 which are disposed inwardly adjacent the cylinders 18, respectively. The legs or arms 28 are parallel upstanding members, the lower end portions of which receive and retain, therebetween, a flat platform seat 30.

The seat 30 is generally rectangular; however, it has a wider forward portion in front of the cylinders 18 and has a reduced width portion adjacent its rearmost portion which is received between the lower end portions of the arms 28.

A resilient elastomeric pad, such as rubber pad 32, is secured to the bottom surface of seat 30 so as to provide a cushioning stop which contacts with the bottom or floor 10 of the tub between the channel members 15 so as to limit the downward movement of the seat 30.

Figure 5:
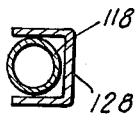
FIG. 5 is a fragmentary view in cross section of an alternative shape of a component part of the seat lift shown in the previous figures may take.

In the embodiment shown in FIG. 5, it is seen that if desired, a U-shaped channel member 128 may be substituted for the legs or arms 28. In such an arrangement, the channel member 128 should be wider than the cylinder such as cylinder 118 so as to encompass the front, rear and inner portions of the cylinder 118. By such an arrangement, the sway of arm 128 can be arrested by the cylinder 118.

Figure 4:
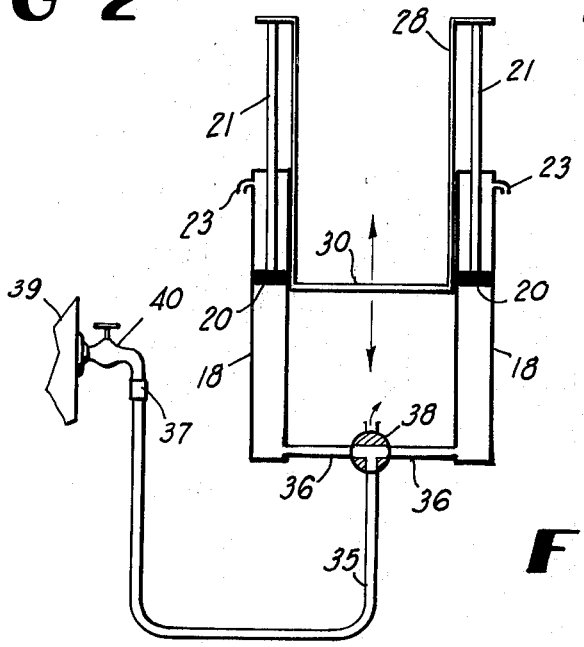
FIG. 4 is a schematic illustration of the portable seat lift shown in the previous figure coupled with an ancillary faucet through which water may be passed in operating the lift.

As seen in FIGS. 1 and 3, a pair of reinforcing struts 33 project upwardly from the rear end portions of the channel members 15 and are secured to an intermediate portion of the cylinders 18, respectively. This provides for more rigidity between the base and the cylinders 18. As illustrated in FIG. 4, a hydraulic line 35 is provided at one end with a quick disconnect coupling 37 by which the flexible hose-like hydraulic line 35 is removeably secured to a faucet 40. In the preferred embodiment, the faucet 40 can be at a sink or wash basin or wall 39 which is remote from the tub, itself. Preferably, the quick disconnect coupling 37 includes a threaded adaptor which replaces a standard aerator on one end of the faucet 40. The other portion of the quick disconnect coupling includes a snap on coupler such as manufactured by General Electric Company under the name UNICOUPLER.

At the distal end of the flexible or hose or line 35 there is provided a three-way valve 38. In turn, the valve 38 is connected to a pair of diverging branch lines 36 which, in turn, are connected to the lower end portions of the two hydraulic cylinders 18, respectively.

A ROTOR VALVE manufactured and sold by Quality Controls, Inc. of Malden, Mass. may be used for valve 38. The valve is provided with an orifice as schematically shown in FIG. 4 through which water or other fluids may exit the valve and hydraulic line into the bounds of the bathtub. Valve actuation is effected by means of a lever 44 mounted to arm 28 which is connected to the valve by a throttle cable 47.

Figure 2:
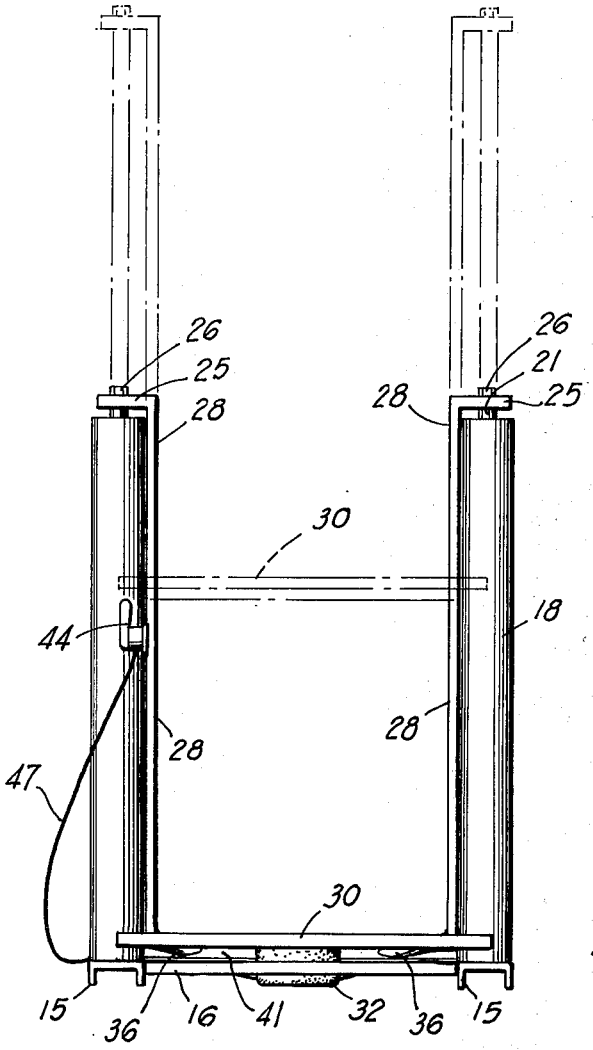
FIG. 2 is a front view in elevation of the seat lift shown in FIG. 1 in the lowered position with an elevatable position shown in broken lines.

For operation, the portable seat lift is set on the floor of the tub and the hydraulic line 35 connected with faucet 40. The seat may then be raised by opening the faucet and manually moving valve actuating lever 44 to the seat raised position. This action moves valve 38 to a position establishing fluid communications between the faucet and the interior of the cylinders. The pressure from the water line thus forces pistons 20 and piston rods 21 upwardly to the seat raised position as shown in dash in FIGS. 2 and 3 at which point the cylinders engage stop means arresting cylinder motion. If desired an intermediate position may be alternatively obtained by actuation of lever 44 to position valve 38 in a manner breaking fluid communications from cylinders 18 with either the valve orifice or the faucet. To lower the seat the valve actuator is moved to its third position establishing fluid communications between the valve orifice and cylinders. In this position the weight of the seat and arms force the seat to descend and water to be urged out of cylinders 18 through throttle limiting restrictions and the valve orifice. In approaching the lowermost position pad 32, mounted to the bottom of seat 30, is brought into engagement atop tub floor 10. As the pad passes between the bounds of the base rather than onto it the seat is enabled to be positioned closely adjacent the bottom of the tub to maximize submersion of a person seated upon the seat lift.

A thin sheet metal or plastic shield 41 covers valve 38 so that a person seated on seat 30 may lean back into a prone position with his back being protected by the shield 41 from contact with the valve 38. The caps 25 provide hand grips which a person may grasp in order to pull himself up in returning from the prone position to a seated position.

Pistons 18 usually project well above the upper edge of the tub so that in its uppermost position, the seat 30 returns the person essentially to his standing position.

It should be understood that the just described embodiment merely illustrates principles of the invention in a preferred form. Many modifications may, of course, be made to the specifically illustrated embodiment without departure from the scope of the invention set forth in the following claims.

I claim:

1. A portable seat lift for a bathtub comprising:

a. a base for mounting on the bathtub floor;

b. a pair of opposed, upstanding, parallel, transversely spaced, cylinders secured by their lower ends to said base, said cylinders being provided respectively with piston rods protruding upwardly through the upper ends of said cylinders, said pistons being moveable between retracted positions and extended positions;

c. a seat disposed between said cylinders for supporting a person in a seated position thereon, said seat extending longitudinally forwardly and rearwardly of said opposed cylinders so as to dispose the seated person in an unobstructed area between said cylinders;

d. a pair of arms disposed between said cylinders and connected by their upper ends respectively to the upper end portions of said rods for movement therewith, said arms extending from said rods downwardly inwardly adjacent said cylinders and being connected by their lower end portions to opposite sides of said seat, said arms being transversely between said cylinders and shielding the body of said person seated on said seat from engagement with said cylinders, said arms being sufficiently long that, when said rods are in their retracted positions, said seat is disposed adjacent to said floor of said bathtub so that said person may recline in said bathtub while remaining on said seat and, when said rods are in their extended positions, said seat is raised so as to lift the person seated therein to a raised position above said floor;

e. means for directing water from the faucet of said tub into said cylinders for applying hydraulic pressure for extending of said rods, said means including a valve having an inlet and an outlet and selectively moveable between a first position in which the water passes from said faucet into said cylinders to extend said rods and a second position for releasing said water from said cylinders through said outlet into said bathtub to permit said rods to retract; said valve including a third position for sealing off the hydraulic cylinders from said inlet and said outlet to maintain said rods and said seat in stationary positions; and f. a lever mounted for movement with said seat, and a throttle cable extending from said lever to said valve for interconnecting the same to permit the positioning of said valve to be controlled by manipulation of said lever.

2. A portable seat lift for a bathtub comprising:

a. a base for mounting on the bathtub floor;

b. a pair of opposed, upstanding, parallel, transversely spaced, cylinders secured by their lower ends to said base, said cylinders being provided respectively with piston rods protruding upwardly through the upper ends of said cylinders, said pistons being moveable between retracted positions and extended positions;

c. a seat disposed between said cylinders for supporting a person in a seated position thereon, said seat extending longitudinally forwardly and rearwardly of said opposed cylinders so as to dispose the seated person in an unobstructed area between said cylinders;

d. a pair of arms disposed between said cylinders and connected by their upper ends respectively to the upper end portions of said rods for movement therewith, said arms extending from said rods downwardly inwardly adjacent said cylinders and being connected by their lower end portions to opposite sides of said seat, said arms being transversely between said cylinders and shielding the body of said person seated on said seat from engagement with said cylinders, said arms being sufficiently long that, when said rods are in their retracted positions, said seat is disposed adjacent to said floor of said bathtub so that said person may recline in said bathtub while remaining on said seat, and, when said rods are in their extended positions, said seat is raised so as to lift the person seated therein to a raised position above said floor; and e. means for directing water from the faucet of said tub into said cylinders for applying hydraulic pressure for extending of said rods, said means including a valve having an inlet and an outlet and selectively moveable between a first position in which the water passes from said faucet into said cylinders to extend said rods and a second position for releasing said water from said cylinders through said outlet into said bathtub to permit said rods to retract;

said valve being disposed between said cylinders and adjacent to an edge of said seat when said seat is adjacent to said floor; and said portable seat lift further including a shield extending over said valve, and control means for operating said valve;

said control means being mounted on one of said arms for movement with and access by the person seated in said seat.

3. A portable seat lift for a bathtub comprising:

a. a base for mounting on the bathtub floor;

b. a pair of opposed, upstanding, parallel, transversely spaced, cylinders secured by their lower ends to said base, said cylinders being provided respectively with piston rods protruding upwardly through the upper ends of said cylinders, said pistons being moveable between retracted positions and extended positions;

c. a seat disposed between said cylinders for supporting a person in a seated position thereon, said seat extending longitudinally forwardly and rearwardly of said opposed cylinders so as to dispose the seated person in an unobstructed area between said cylinders;

d. a pair of arms disposed between said cylinders and connected by their upper ends respectively to the upper end portions of said rods for movement therewith, said arms extending from said rods downwardly inwardly adjacent said cylinders and being connected by their lower end portions to opposite sides of said seat, said arms being transversely between said cylinders and shielding the body of said person seated on said seat from engagement with said cylinders, said arms being sufficiently long that, when said rods are in their retracted positions, said seat is disposed adjacent to said floor of said bathtub so that said person may recline in said bathtub while remaining on said seat and, when said rods are in their extended positions, said seat is raised so as to lift the person seated therein to a raised position above said floor; and e. means for directing water from the faucet of said tub into said cylinders for applying hydraulic pressure for extending of said rods, said means including a valve having an inlet and an outlet and selectively moveable between a first position in which the water passes from said faucet into said cylinders to extend said rods and a second position for releasing said water from said cylinders through said outlet into said bathtub to permit said rods to retract;

said arms being channel members partially surrounding said cylinders.

* * * * *